US011187081B1

(12) United States Patent
Pan et al.

(10) Patent No.: US 11,187,081 B1
(45) Date of Patent: Nov. 30, 2021

(54) SELF-ANCHORED OPPOSITE-PULLING ANTI-IMPACT ANCHOR CABLE FOR SECTIONAL COAL PILLARS AND USING METHOD THEREOF

(71) Applicants: LIAONING UNIVERSITY, Shenyang (CN); Beijing Chengtian Hengye Coal Mine Equipment Co. Ltd, Beijing (CN)

(72) Inventors: Yishan Pan, Shenyang (CN); Hongying Wang, Beijing (CN); Lianpeng Dai, Beijing (CN); Aiwen Wang, Beijing (CN); Zhicai Chen, Beijing (CN); Yonghui Xiao, Beijing (CN)

(73) Assignees: LIAONING UNIVERSITY, Shenyang (CN); BEIJING CHENGTIAN HENGYE COAL MINE EQUIPMENT CO. LTD, Beijing (CN)

( * ) Notice: Subject to any disclaimer, the term of this patent is extended or adjusted under 35 U.S.C. 154(b) by 0 days.

(21) Appl. No.: 17/072,947

(22) Filed: Oct. 16, 2020

(30) Foreign Application Priority Data

Jun. 22, 2020 (CN) ..... 202010575970.X

(51) Int. Cl.
*E21D 21/00* (2006.01)

(52) U.S. Cl.
CPC ..... *E21D 21/006* (2016.01); *E21D 21/0006* (2013.01); *E21D 21/008* (2013.01); *E21D 21/0033* (2013.01)

(58) Field of Classification Search
CPC ..... E21D 21/0069; E21D 21/0006; E21D 21/0033; E21D 21/008; E21D 21/0026; E21D 21/0093
See application file for complete search history.

(56) References Cited

U.S. PATENT DOCUMENTS 5,232,311 A * 8/1993 Stankus ..... E21D 21/008 405/259.4
2005/0123361 A1* 6/2005 Robertson, Jr. ..... E21D 21/008 405/259.4

(Continued)

FOREIGN PATENT DOCUMENTS

CN 101251138 A 8/2008
CN 104631820 A 5/2015

(Continued)

*Primary Examiner* — Benjamin F Fiorello
(74) *Attorney, Agent, or Firm* — Volpe Koenig

(57) ABSTRACT

The present invention discloses a self-anchored opposite-pulling anti-impact anchor cable for sectional coal pillars and a using method thereof. The anchor cable includes a steel strand (100), with an energy-absorbing and yielding terminal (200) and a stressed expansion-cracking terminal (300) respectively fixed to two ends of the steel strand, a bushing (400) sleeved outside the steel strand, a first lock (610) provided at one end of the steel strand and a second lock (620) provided at the other end of the steel strand; the stressed expansion-cracking terminal includes a self-anchored bushing (420) with a plurality of pre-splitting lines (440) arranged in the wall of the self-anchored bushing. Under stress, the wall of the self-anchored bushing cracks along the pre-splitting lines and bends and expands, so that it abuts against and is self-anchored to the edge of a sectional coal pillar at the outer side.

18 Claims, 8 Drawing Sheets

(56) References Cited

U.S. PATENT DOCUMENTS

| | | | | |
|---|---|---|---|---|
| 2006/0018721 | A1* | 1/2006 | Robertson, Jr. | E21D 21/008 405/259.4 |
| 2008/0247839 | A1* | 10/2008 | Seegmiller | E21D 21/008 411/44 |
| 2009/0191007 | A1* | 7/2009 | Seegmiller | E21D 21/008 405/259.5 |
| 2011/0217126 | A1* | 9/2011 | Oldsen | E21D 21/0033 405/259.4 |
| 2019/0390550 | A1* | 12/2019 | Abreu | E21D 21/0046 |

FOREIGN PATENT DOCUMENTS

| | | | |
|---|---|---|---|
| CN | 109026103 | A | 12/2018 |
| CN | 209800003 | U | 12/2019 |
| CN | 109209457 | B | 1/2020 |

* cited by examiner

SELF-ANCHORED OPPOSITE-PULLING ANTI-IMPACT ANCHOR CABLE FOR SECTIONAL COAL PILLARS AND USING METHOD THEREOF

FIELD

The present invention relates to the field of downhole safety protection in coal mines, in particular to a self-anchored opposite-pulling anti-impact anchor cable for sectional coal pillars and a using method thereof.

BACKGROUND

With the rapid increase of mining depth and intensity in China, the intensity, frequency and disaster degree of rock burst in coal mines have increased severely, and rock burst has become one of common dynamic safety disasters in deep mining. With a long-wall mining method for deep coal seams, sectional coal pillars are often arranged along adjacent mining faces, and the sectional coal pillars may vary in size, and may be 3-20 m generally and 6-9 m in common, depending on the geological conditions. However, affected by high-intensity exploitation, stress concentration may occur easily in the sectional coal pillars between adjacent mining faces as a result of superposition of mining stress, and the sectional coal pillars with concentrated stress have become areas with frequent large roadway deformation and rock burst in deep mines. In addition, the strata in some coal mines are rich in ground water, which results in severe water accumulation at the goaf side of the coal pillars. The bearing capacity of the coal pillars soaked and softened by the accumulated goaf water is decreased, and the risk of coal pillar rock burst is aggravated.

To solve the above engineering problem, traditionally resin anchor rods or anchor cables are used for reinforcing the coal pillar structure in the prior art. However, the coal mass medium is excessively damaged and deteriorated owing to large deformation of the sectional coal pillars. Consequently, the existing anchor bolt-net-cable may be "drawn out" failure as the coal pillars excessively deformed and the coal rock at the anchored end is damaged and deteriorated. Even the anchor rods are provided with yielding and energy-absorbing means that can adapt to the large deformation of the coal rock, the engineering purpose of energy absorption and coal and rock mass reinforcement in a stable state can't be attained. For example, the Chinese Patent Publication No. CN109209457B has disclosed an energy-absorbing anti-impact anchor cable and a using method thereof, which can effectively avoid impact deformation and damage of the surrounding rock, effectively prevent and control rock burst, and may be applied under different working conditions in different application environments. As shown in FIG. 1, an end portion A1 of the anchor cable A disclosed in the above-mentioned patent document is inserted inside the coal pillar B through a hole drilled in the coal pillar B, and is fixed inside the coal pillar B by bonding with an anchoring agent; the other end portion of the anchor cable A is fixed to the outer side of the coal pillar B by means of a bearing tray A2. When the coal pillar B is subjected to force F, compressional deformation of the coal pillar B occurs in the stressed direction, and the two sides B1 of the coal pillar B will be deformed under Poisson effect and tend to form bulged edges B2. Under the action of the bulged edges B2, the bearing tray A2 of the anchor cable A tends to move outward and disengage from the coal pillar B; in addition, the end A1 of the anchor cable A may get loose and become ineffective since it is fixed inside the coal pillar B by bonding.

Based on the above problems, to effectively improve the stability of a coal pillar in a high-stress deep well section, three aspects should be considered comprehensively, i.e., the coal pillar medium, the material of the anchor cable, and the interaction between the coal pillar and the anchor cable. Firstly, the mine water around the coal pillar medium shall be drained to avoid persistent soaking and damage of the coal mass and thereby improve the self-stability of the coal mass; secondly, the anchorage of the anchor cable shall avoid or adapt to the damage of the coal rock medium and prevent the deterioration and failure of the anchored end; finally, on the premise of effective supporting, the material of the anchor cable shall have high deformability, so as to adapt to the large deformation of the coal pillar, realize coordinated steady deformation of the coal mass and anchor cable, and prevent overload and fracture of the anchor cable, which may cause more severe coal pillar instability and rock burst accidents. That is to say, it is urgent to develop an anchor cable that exerts opposite pulling on the two sides of the coal pillar, can be fixed by self-anchorage, and can realize water drainage while effectively absorbing energy, providing impact protection, and adapting to large deformation, on the basis of the prior art.

SUMMARY

To solve the problems that the existing anchor cables are deformed with the coal pillars, can't attain effects of absorbing energy, maintaining stability, and reinforcing the coal and rock mass owing to the failure of the anchored end, and are infiltrated and damaged by drained mine water in the prior art, the present invention provides a self-anchored opposite-pulling anti-impact anchor cable for sectional coal pillars and a using method thereof. The self-anchored opposite-pulling anti-impact anchor cable for sectional coal pillars can achieve mechanical self-anchorage, coordination of energy absorption and impact resistance with large deformation, and safe drainage of accumulated water at the goaf side of the coal pillar, and has a simple and compact structure, and high safety and controllability.

To attain the object described above, in one aspect, the present invention provides a self-anchored opposite-pulling anti-impact anchor cable for sectional coal pillars, which comprises a steel strand, with an energy-absorbing and yielding terminal and a stressed expansion-cracking terminal respectively fixed to two ends of the steel strand, and a bushing sleeved outside the steel strand, wherein a first lock is provided at one end of the steel strand for locking the energy-absorbing and yielding terminal to the steel strand, and a second lock is provided at the other end of the steel strand for locking the stressed expansion-cracking terminal to the steel strand; the stressed expansion-cracking terminal comprises a self-anchored bushing with a plurality of pre-splitting lines arranged in the wall of the self-anchored bushing. Under stress, the wall of the self-anchored bushing cracks along the pre-splitting lines and bends and expands, so that it abuts against and is self-anchored to the edge of a sectional coal pillar at the outer side.

Optionally, the first lock comprises a first self-locking inner ring sleeved outside the steel strand and a first self-locking outer ring movably compressed on the first self-locking inner ring, and the first self-locking inner ring and the first self-locking outer ring are self-locked and compressed to each other by means of first bevel surfaces that are arranged correspondingly; the second lock comprises a second self-locking inner ring sleeved outside the steel strand and a second self-locking outer ring movably compressed on the second self-locking inner ring, and the second self-locking inner ring and the second self-locking outer ring are self-locked and compressed to each other by means of second bevel surfaces that are arranged correspondingly.

Optionally, the first self-locking outer ring and the energy-absorbing and yielding terminal are arranged integrally; and the second self-locking outer ring and the stressed expansion-cracking terminal are arranged integrally.

Optionally, the bushing comprises a water drainage bushing sleeved outside the energy-absorbing and yielding terminal and a self-anchored bushing sleeved outside the stressed expansion-cracking terminal, and the water drainage bushing and the self-anchored bushing are connected via a telescopic energy-absorbing tube.

Optionally, an anchor cable tray is provided outside the end of the water drainage bushing, and an end of the water drainage bushing is connected with the anchor cable tray by means of threads that are arranged correspondingly.

Optionally, the plurality of pre-splitting lines are arranged in parallel to each other at a constant angle in the circumferential direction in the wall of the self-anchored bushing.

Optionally, a crack-arresting ring is arranged on the outer wall of the self-anchored bushing at a position in front of the telescopic energy-absorbing tube in a direction in which the self-anchored opposite-pulling anti-impact anchor cable for sectional coal pillars is inserted into the sectional coal pillar.

Optionally, the outer wall of the self-anchored bushing has a bonding portion that accommodates a resin anchoring agent that can be released under extrusion, and the bonding portion is arranged near the crack-arresting ring.

Optionally, the water drainage bushing comprises an enlarged section and a straight section having an inner diameter smaller than the inner diameter of the enlarged section, and the enlarged section is connected with the straight section through a transition section;

the energy-absorbing and yielding terminal is arranged inside the enlarged section, and comprises a first cylindrical section and a circular-arc truncated cone section, and the periphery of the end face of the circular-arc truncated cone section is positioned in fit to the transition section after the self-anchored opposite-pulling anti-imp act anchor cable for sectional coal pillars is mounted on the sectional coal pillar;

when the sectional coal pillar is deformed under stress after the self-anchored opposite-pulling anti-impact anchor cable for sectional coal pillars is mounted on the sectional coal pillar, the energy-absorbing and yielding terminal moves axially along the water drainage bushing and thereby force the transition section to deform and displace, so that the enlarged section is elongated and absorbs energy.

Optionally, the stressed expansion-cracking terminal comprises a second cylindrical section and a circular truncated cone section, and an truncated cone end face of the circular truncated cone section is oriented to the self-anchored bushing, after the self-anchored opposite-pulling anti-impact anchor cable for sectional coal pillars is mounted on the sectional coal pillar, the truncated cone end face extrudes the wall of the self-anchored bushing, so that the wall of the self-anchored bushing cracks, bends and expands along the pre-splitting lines.

Optionally, an annular space is reserved between the inner wall of the bushing and the outer surface of the steel strand, and, after the self-anchored opposite-pulling anti-impact anchor cable for sectional coal pillars is mounted on the sectional coal pillar, two ends of the annular space work with a side of the energy-absorbing and yielding terminal that faces the annular space and a side of the stressed expansion-cracking terminal that faces the annular space respectively to enclose and form an enclosed drainage path, the energy-absorbing and yielding terminal and the stressed expansion-cracking terminal are respectively provided with a drainage hole there-through, and the drainage path is in communication with the drainage holes.

Optionally, the cross section of the annular space accounts for 30-50% of the overall cross section of the inner cavity of the bushing.

Optionally, the drainage holes are a plurality of through-holes that are circumferentially arranged at a constant angle in the axial direction of the energy-absorbing and yielding terminal and the stressed expansion-cracking terminal.

Optionally, the center line of the longitudinal section of the through-hole is an arc line.

In a second aspect, the present invention provides a method of using the self-anchored opposite-pulling anti-impact anchor cable for sectional coal pillars as described above, which comprises the following steps:

step 100: drilling a hole from one side of the sectional coal pillar toward the other side of the sectional coal pillar, with 100 mm-200 mm spacing reserved between the bottom of the drilled hole and the penetration surface on the other side of the sectional coal pillar;

step 200: plugging the drainage hole in the energy-absorbing and yielding terminal of the self-anchored opposite-pulling anti-impact anchor cable for sectional coal pillars in advance, and inserting the self-anchored opposite-pulling anti-impact anchor cable for sectional coal pillars to the bottom of the drilled hole, so that the self-anchored opposite-pulling anti-impact anchor cable for sectional coal pillars presses the drilled hole and penetrates through the spacing reserved in the step 100;

step 300: pressing the bushing and pulling the steel strand outwards, till the end of the bushing is split and then seals the drilled hole and is fixed inside the drilled hole, thus the self-anchored opposite-pulling anti-impact anchor cable for sectional coal pillars is mounted on the sectional coal pillar;

step 400: opening the drainage hole and draining the accumulated water timely.

Optionally, the method further comprises the following step before the step 100: calculating and selecting the matching parameters of the self-anchored opposite-pulling anti-impact anchor cable for sectional coal pillars according to the working conditions.

Optionally, the step 100 specifically comprises: selecting a drill bit in size matching the size of the bushing and drilling a hole with the drill bit to the other side of the sectional coal pillar during the roadway driving along the mining face in the lower section.

Optionally, the step 400 comprises: monitoring the fluid pressure in the bushing, and opening the drainage hole to drain water when the fluid pressure exceeds a pressure threshold; the pressure threshold is 0.2 MPa-0.5 MPa.

With the above technical scheme, the self-anchored opposite-pulling anti-imp act anchor cable for sectional coal pillars provided by the present invention can simultaneously realize three functions of safe drainage of accumulated water at the goaf side of the coal pillar, coordination of energy absorption and impact resistance with large deformation, and mechanical self-anchorage of the anchor cable. According to the strength and deformation condition of the coal and rock mass of the sectional coal pillar, the self-anchored opposite-pulling anti-impact anchor cable for sectional coal pillars can be used in conjunction with coal mass cementing process and protection of coal pillars in the roadway with steel beams, and the like, and has a simple and compact structure and high safety and controllability.

REFERENCE NUMBERS

100—steel strand; 200—energy-absorbing and yielding terminal; 210 —through-hole; 220—first through-hole; 230—first cylindrical section; 240—circular-arc truncated cone section; 300—stressed expansion-cracking terminal; 310—second cylindrical section; 320—circular truncated cone section; 330—second through-hole; 400—bushing; 410—water drainage bushing; 411—enlarged section; 412—straight section; 413—transition section; 420—self-anchored bushing; 430—telescopic energy-absorbing tube; 440—pre-splitting line; 450—crack-arresting ring; 460—bonding portion; 500—anchor cable tray; 510—connecting end; 520—fixing end; 610—first lock; 611—first self-locking inner ring; 612—first self-locking outer ring; 613—first bevel surface; 620—second lock; 621—second self-locking inner ring; 622—second self-locking outer ring; 623—second bevel surface; 1000—goaf of mining face in upper section; 2000—goaf of mining face in lower section; 3000—goaf water in upper section; 4000—sectional coal pillar; S—annular space; P—drainage path; P1—drainage hole; A—anchor cable; A1—end portion; B—coal pillar; A2—bearing tray; B2—bulged edge; R—radius of bushing; t—wall thickness of bushing; r—radius of steel strand; Rdrill —radius of a drilled hole; n—construction error coefficient.

DETAILED DESCRIPTION

Hereunder some embodiments of the present invention will be detailed with reference to the accompanying drawings. It should be understood that the embodiments described herein are only provided to describe and explain the present invention rather than constitute any limitation to the present invention.

In the present invention, unless otherwise specified, the terms that denote the orientations are used as follows, for example: "top", "bottom", "left" and "right" usually refer to "top", "bottom", "left" and "right" as shown in the accompanying drawings; "inside" and "outside" usually refer to inside and outside in relation to the profiles of the components; and "distal" and "proximal" usually refer to distal and proximal positions with respect to the outlines of the components.

Embodiment 1

Figure 2:
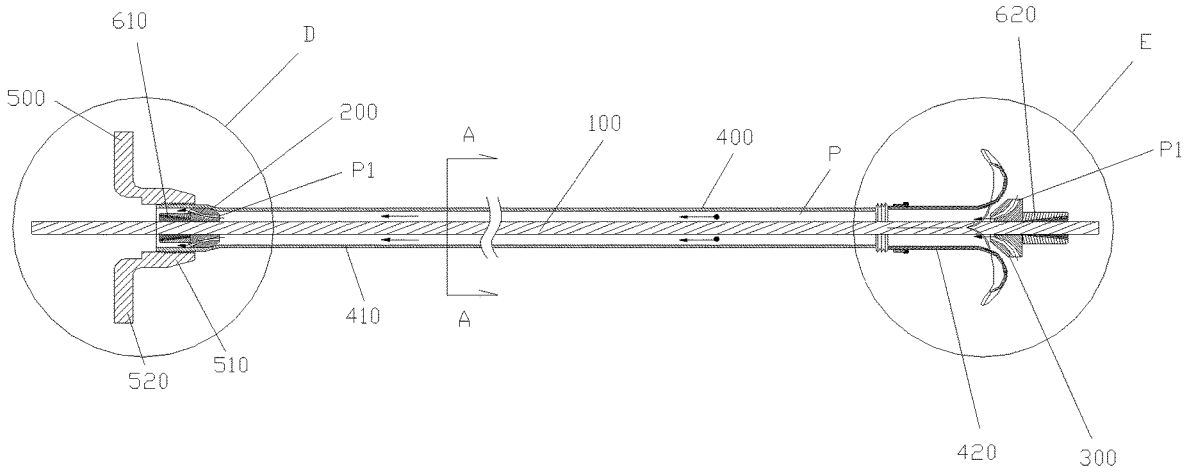
FIG. 2 is a schematic diagram of the overall structure of the self-anchored opposite-pulling anti-impact anchor cable for sectional coal pillars in embodiment 1 of the present invention.

As shown in FIG. 2, the present invention provides a self-anchored opposite-pulling anti-impact anchor cable for sectional coal pillars, which comprises a steel strand 100, with an energy-absorbing and yielding terminal 200 and a stressed expansion-cracking terminal 300 respectively fixed to two ends of the steel strand 100, and a bushing 400 sleeved outside the steel strand 100, wherein a first lock 610 is provided at one end of the steel strand 100 for locking the energy-absorbing and yielding terminal 200 to the steel strand 100, and a second lock 620 is provided at the other end of the steel strand 100 for locking the stressed expansion-cracking terminal 300 to the steel strand 100; the stressed expansion-cracking terminal 300 comprises a self-anchored bushing 420 with a plurality of pre-splitting lines 440 arranged in the wall of the self-anchored bushing 420, and the wall of the self-anchored bushing 420 cracks along the pre-splitting lines 440 and bends and expands under stress, so that it abuts against and is self-anchored to the edge of a sectional coal pillar at the outer side. It is seen from the above description: the anchor cable provided by the present invention realizes three functions of mechanical self-anchoring of the anchor cable, coordination of energy absorption and impact resistance with large deformation, and safe drainage of accumulated water in the goaf side of the coal pillar simultaneously, and has a simple and compact structure and high safety and controllability.

Figure 3:
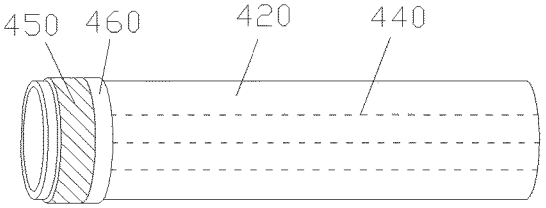
FIGS. 3 and 4 are partial schematic structural diagrams of the self-anchored bushing before and after it cracks, bends, and expands.
Figure 4:
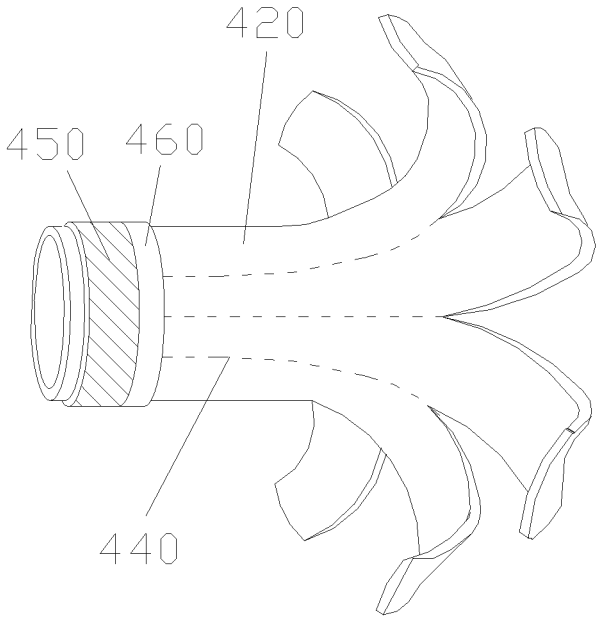

As shown in FIG. 2 in conjunction with FIGS. 3 and 4, the stressed expansion-cracking terminal 300 comprises a self-anchored bushing 420, with a plurality of pre-splitting lines 440 arranged in parallel to each other in the wall of the self-anchored bushing 420 in the circumferential direction at a constant angle, to facilitate the mounting and positioning of the self-anchored opposite-pulling anti-impact anchor cable for sectional coal pillars on the sectional coal pillar; in order to facilitate processing and maintain a regular and stable shape of the wall of the end portion of the self-anchored bushing 420 after splitting, usually an even number of pre-splitting lines 440 are provided and uniformly distributed annularly. In actual applications, the specific number of the pre-splitting lines 440 in the implementation may be adjusted as required. Under stress, the wall of the self-anchored bushing 420 cracks along the pre-splitting lines 440 and bends and expands, so that it abuts against and is self-anchored to the edge of the sectional coal pillar 4000 at the outer side. Usually, the self-anchored bushing 420 is a metal circular tube made of a low carbon steel material and has high impact strength. The wall thickness of the self-anchored bushing 420 may be adjusted and set according to the splitting resistance in the "bulging-splitting" action between the self-anchored bushing and the stressed expansion-cracking terminal 300, and is usually about 8 mm-10 mm. Similarly, the length of the self-anchored bushing 420 may also be adjusted and set according to the degree of size matching with the anchoring hole in the field. To prevent excessive splitting of the wall of the self-anchored bushing 420 under stress, a crack-arresting ring 450 is arranged on the outer wall of the self-anchored bushing 420 at a position in front of the telescopic energy-absorbing tube 430 in a direction in which the self-anchored opposite-pulling anti-impact anchor cable for sectional coal pillars is inserted into the sectional coal pillar.

Figure 5:
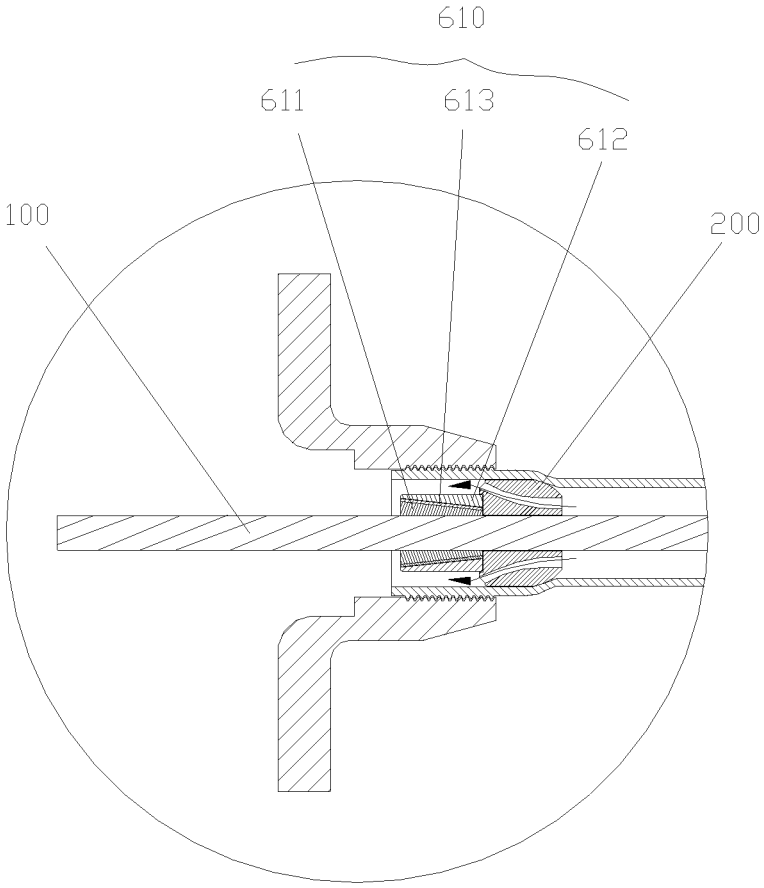
FIGS. 5 and 6 are enlarged views of the parts D and E of the structure in FIG. 2.
Figure 6:
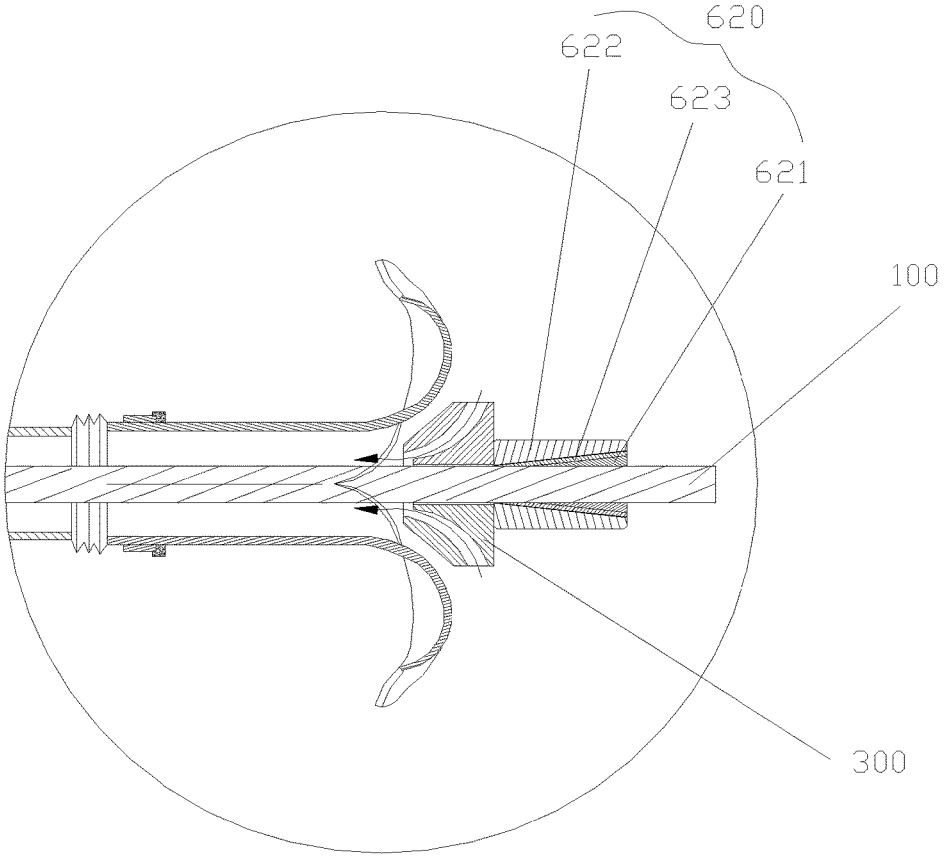

As shown in FIGS. 5 and 6, in this embodiment, wherein the first lock 610 comprises a first self-locking inner ring 611 sleeved outside the steel strand 100 and a first self-locking outer ring 612 movably compressed on the first self-locking inner ring 611, and the first self-locking inner ring 611 and the first self-locking outer ring 612 are self-locked and compressed to each other by means of first bevel surfaces 613 that are arranged correspondingly. The second lock 620 comprises a second self-locking inner ring 621 sleeved outside the steel strand 100 and a second self-locking outer ring 622 movably compressed on the second self-locking inner ring 621, and the second self-locking inner ring 621 and the second self-locking outer ring 622 are self-locked and compressed to each other by means of second bevel surfaces 623 that are arranged correspondingly. As shown in FIGS. 5 and 6, in this embodiment, the first lock 610 and the energy-absorbing and yielding terminal 200 are two separate components that are adjacent to and abut against each other; likewise, the second lock 620 and the stressed expansion-cracking terminal 300 are also two separate components that are adjacent to and abut against each other.

Figure 7:
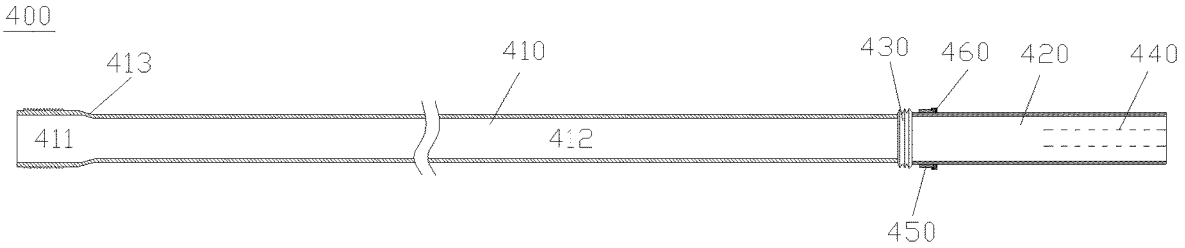
FIGS. 7 and 8 are schematic structural diagrams of the bushing end before and after it cracks, bends and expands.
Figure 9:
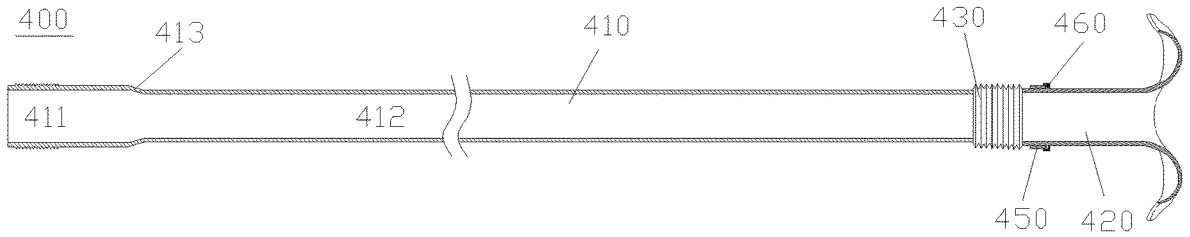
FIG. 9 is a schematic structural diagram of the bushing after twice energy absorption.

As shown in FIGS. 7 and 9, the bushing 400 comprises a water drainage bushing 410 sleeved outside the energy-absorbing and yielding terminal 200 and a self-anchored bushing 420 sleeved outside the stressed expansion-cracking terminal 300, and the water drainage bushing 410 and the self-anchored bushing 420 are connected via a telescopic energy-absorbing tube 430. A compression-resistant telescopic energy-absorbing tube 430 is connected between the self-anchored bushing 420 and the water drainage bushing 410 to ensure a sealed drainage space and prevent the accumulated water from flowing into the drilled hole and soaking the coal mass. Usually, the water drainage bushing 410 has the same inner diameter as the self-anchored bushing 420. The telescopic energy-absorbing tube 430 may be elongated in the mounting process of the self-anchored opposite-pulling anti-impact anchor cable for sectional coal pillars on the sectional coal pillar and thereby absorbs the deformation of the bushing 400 in the axial direction.

Figure 8:
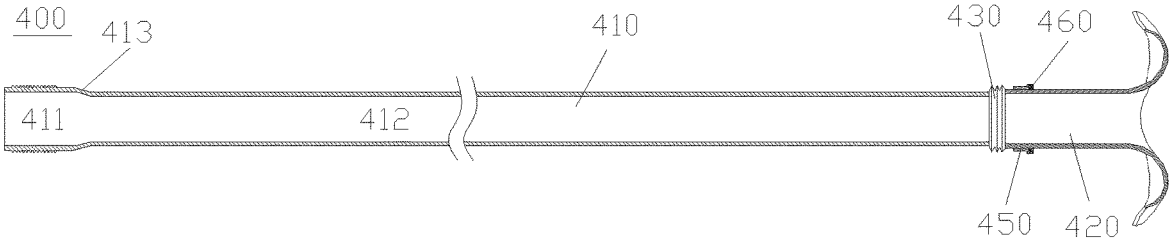

As shown in FIGS. 7 and 8, the water drainage bushing 410 further comprises an enlarged section 411 and a straight section 412 having inner diameter smaller than the inner diameter of the enlarged section 411, and the enlarged section 411 is connected with the straight section 412 through a transition section 413. Usually, the water drainage bushing 410 is a metal circular pipe made of a low carbon steel material. As shown in FIG. 8 in conjunction with FIGS. 2, 5, 10, and 11, the energy-absorbing and yielding terminal 200 is arranged in the enlarged section 411, and comprises a first cylindrical section 230 and a circular-arc truncated cone section 240, and has a first through-hole 220 therein. The steel strand 100 in the self-anchored opposite-pulling anti-impact anchor cable for sectional coal pillars is threaded through the first through-hole 220. The inner diameter of the first through-hole 220 may be slightly greater than the outer diameter of the steel strand 100, to facilitate threading the steel strand 100 through the first through-hole 220. After the self-anchored opposite-pulling anti-impact anchor cable for sectional coal pillars is mounted on the sectional coal pillar, the periphery of the end face of the circular-arc truncated cone section 240 is positioned in fit with the transition section 413. The diameter of the end face of the first cylindrical section 230 of the energy-absorbing and yielding terminal 200 is equal to the inner diameter of the enlarged section 411 of the water drainage bushing 410, the diameter of the end face of the circular-arc truncated cone section 240 is smaller than the inner diameter of the enlarged section 411 of the water drainage bushing 410, and the circular truncated cone section 240 is positioned in fit with the transition section 413, so as to ensure that the water drainage bushing 410 is extruded to bulge and yield successfully. As shown in FIGS. 8 and 9, when the sectional coal pillar is deformed under stress after the self-anchored opposite-pulling anti-impact anchor cable for sectional coal pillars is mounted on the sectional coal pillar, the energy-absorbing and yielding terminal 200 moves axially along the water drainage bushing 410 and thereby force the transition section 413 to deform and displace, so that the enlarged section 411 is elongated and absorbs energy. The structure of the enlarged section 411 after deformation is shown in FIG. 9.

As shown in FIGS. 8 and 9, once deformation of the sectional coal pillar occurs after the self-anchored opposite-pulling anti-impact anchor cable for sectional coal pillars shown in FIG. 2 in the present invention is mounted and positioned on the sectional coal pillar, the deformation can be absorbed by means of deformation at two portions, and thereby an impact protection and energy absorption effect is attained. Specifically, first, primary energy absorption can be achieved by elongation of the telescopic energy-absorbing tube 430; secondly, secondary energy absorption can be achieved by elongation of the enlarged section 411 of the water drainage bushing 410. It should be noted that the telescopic energy-absorbing tube 430 is usually configured to be an extensible stacked structure made of an elastoplastic functional tube material, which absorbs energy mainly by plastic deformation when it is elongated, and exhibits an elastic recovery property. That is to say, the telescopic energy-absorbing tube 430 can be elongated along with the transition section 413, and has elastic recovery ability integrally to maintain pre-tightening force excellently. To complete the above-mentioned process of twice energy absorption, the components of the self-anchored opposite-pulling anti-impact anchor cable for sectional coal pillars have the following strength relationship among them: the strength of the threaded connection of the anchor cable tray 500 is equal to the strength of the self-anchorage of the self-anchored bushing 420 and greater than the breaking strength of the steel strand 100, i.e., the steel strand will not be broken under the deforming force when the two ends of the anchor cable are fixed to the two sides of the sectional coal pillar; the breaking strength of the steel strand 100 is greater than the diameter expansion and energy absorption resistance of the transition section 413, which is equal to the energy absorption resistance of the telescopic energy-absorbing tube 430.

As shown in FIG. 2, to facilitate fixing, an anchor cable tray 500 is provided outside the end of the water drainage bushing 410, and the end of the water drainage bushing 410 is connected with the anchor cable tray 500 by means of threads that are arranged correspondingly. In the embodiment shown in FIG. 2, the anchor cable tray 500 includes a connecting end 510 and a fixing end 520 perpendicular to the connecting end 510, wherein the connecting end 510 is used for connecting the water drainage bushing 410, male threads are arranged on the outer surface of the water drainage bushing 410, female threads are arranged on the inner surface of the connecting end 510, and the male threads correspond to the female threads. The fixing end 520 is used to mount and position the self-anchored opposite-pulling anti-imp act anchor cable for sectional coal pillars on the sectional coal pillar in the mounting process.

Furthermore, in order to effectively fix the self-anchored opposite-pulling anti-impact anchor cable for sectional coal pillars after it is placed in the mounting position on the sectional coal pillar, the outer wall of the self-anchored bushing 420 has a bonding portion 460 that accommodates a resin anchoring agent and is arranged near the crack-arresting ring 450. When the self-anchored bushing 420 cracks along the pre-splitting lines 440 under stress and bends and expands to the position of the crack-arresting ring 450, the cracked root of the wall of the self-anchored bushing 420 squeezes the bonding portion 460, so that the resin anchoring agent inside the bonding portion 460 is released, and is distributed between the outer wall of the self-anchored bushing 420 and the drilled hole in the sectional coal pillar, and seals the space there to prevent the accumulated water from infiltrating into and soaking the coal mass from the self-anchored end.

Figure 12:
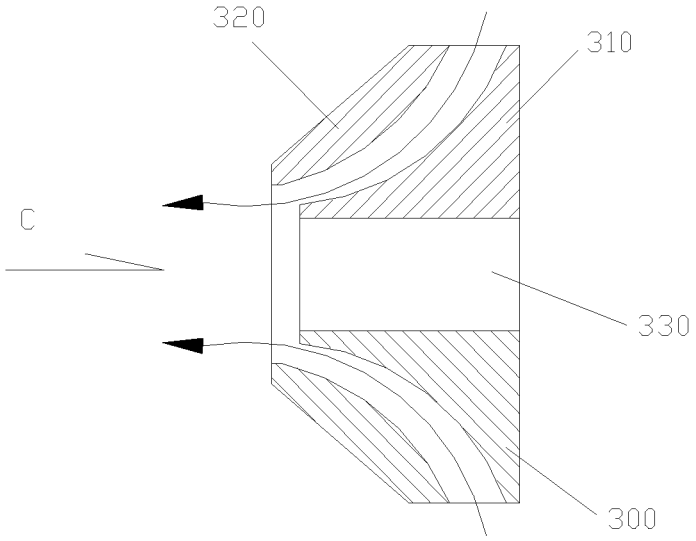
FIG. 12 is an axial sectional view of the stressed expansion-cracking terminal.
Figure 13:
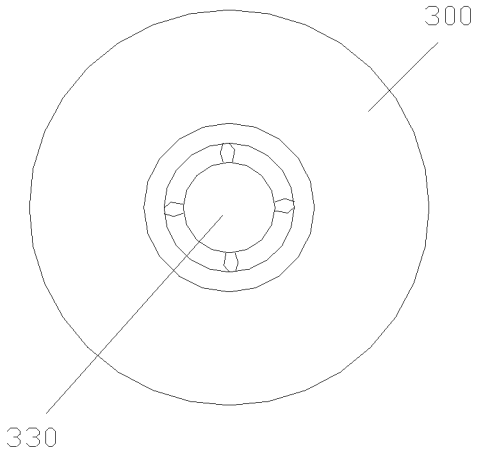
FIG. 13 is a view of the structure shown in FIG. 12 in direction C.

As shown in FIGS. 12 and 13, the stressed expansion-cracking terminal 300 comprises a second cylindrical section 310 and a circular truncated cone section 320, the truncated cone end face of the circular truncated cone section 320 is oriented to the self-anchored bushing 420, and the stressed expansion-cracking terminal 300 has a second through-hole 330 therein. The steel strand 100 in the self-anchored opposite-pulling anti-impact anchor cable for sectional coal pillars is threaded through the second through-hole 330; similarly, the inner diameter of the second through-hole 330 may be slightly greater than the outer diameter of the steel strand 100 to facilitate the threading work. After the self-anchored opposite-pulling anti-impact anchor cable for sectional coal pillars is mounted on the sectional coal pillar, the truncated cone end face extrudes the wall of the self-anchored bushing 420, so that the wall of the self-anchored bushing cracks, bends and expands along the pre-splitting lines 440. The diameter of the end face of the circular truncated cone section 320 of the stressed expansion-cracking terminal 300 is smaller than the inner diameter of the self-anchored bushing 420, and the diameter of the end face of the second cylindrical section 310 is greater than the inner diameter of the self-anchored bushing 420 where the pre-splitting lines 440 are arranged, so as to ensure that the self-anchored bushing 420 can be split and self-anchored successfully under stress.

Figure 14:
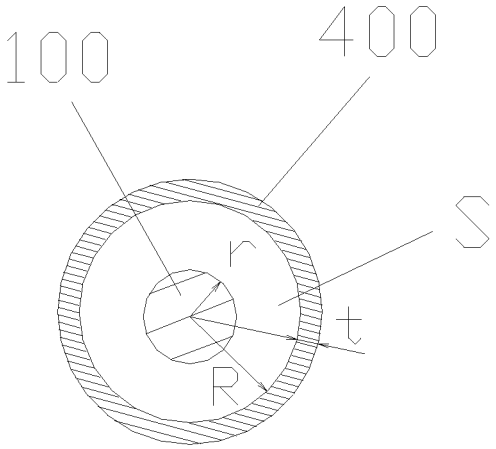
FIG. 14 is a broken-out sectional view A-A of the structure shown in FIG. 2.

In the embodiment shown in FIG. 2, a bushing 400 is sleeved outside the steel strand 100, an annular space S is reserved between the inner wall of the bushing 400 and the outer surface of the steel strand 100, and, after the self-anchored opposite-pulling anti-impact anchor cable for sectional coal pillars is mounted on the sectional coal pillar, the two ends of the annular space S work with a side of the energy-absorbing and yielding terminal 200 that faces the annular space S and a side of the stressed expansion-cracking terminal 300 that faces the annular space S respectively to enclose and form an enclosed drainage path P, the energy-absorbing and yielding terminal 200 and the stressed expansion-cracking terminal 300 are respectively provided with a drainage hole P1 there-through, and the drainage path P is in communication with the drainage holes P1. As shown in FIG. 14, usually the cross section of the annular space S accounts for 30-50% of the overall cross section of the inner cavity of the bushing 400. The specific calculation formula is as follows:

$$\frac{\pi R^2 - \pi r^2}{\pi R^2} = 30\% - 50\%$$

Where:

R—radius of the bushing; t—wall thickness of the bushing; r—radius of the steel strand, usually is 21.8 mm;

the radius of the drilled hole is determined as: Rdrill=n×(R+t);

n—construction error coefficient, usually is 5%-8%.

In actual applications, it is necessary to select and adjust the area of the annular space S according to the requirements of the drainage environment. In addition, it should be noted: since the self-anchored opposite-pulling anti-impact anchor cable for sectional coal pillars provided by the present invention is applicable to downhole safety protection in coal mines, where the drained goaf water may include foreign substances such as silt and powder coal, etc., aiding means may be used to prevent the drainage path and the drainage hole from blocked. However, that aspect is not an important consideration in the present invention, and will not be detailed here.

Figure 10:
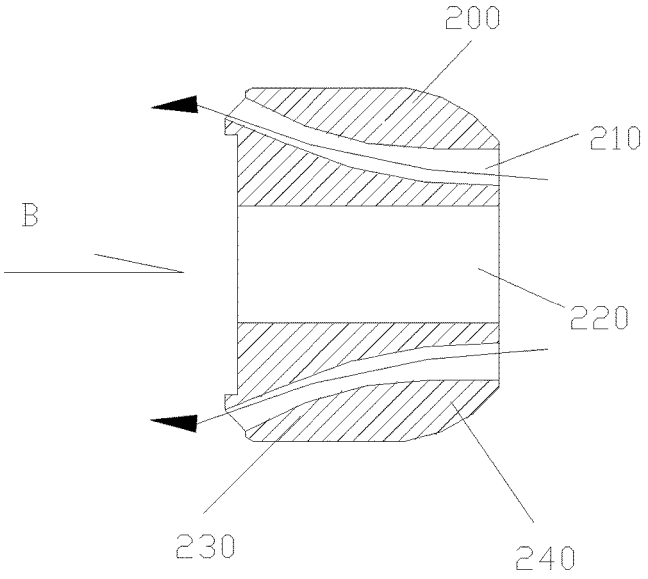
FIG. 10 is an axial sectional view of the energy-absorbing and yielding terminal.
Figure 11:
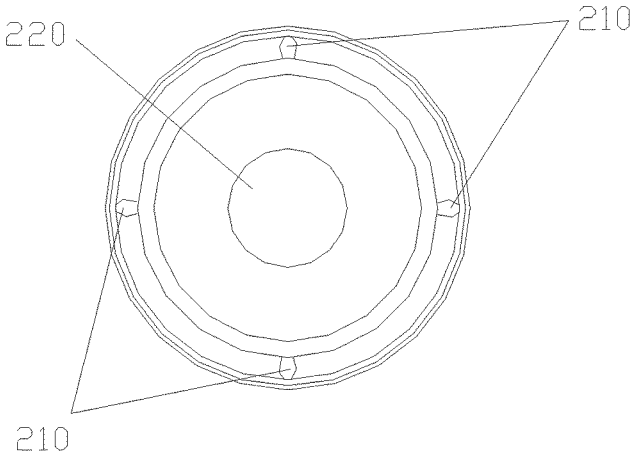
FIG. 11 is a view of the structure shown in FIG. 10 in direction B.

As shown in FIGS. 10 and 11, the drainage hole comprises a plurality of through-holes 210 arranged circumferentially at a constant angle in the axial direction of the energy-absorbing and yielding terminal 200. More specifically, to adapt to the structures of other parts of the self-anchored opposite-pulling anti-imp act anchor cable for sectional coal pillars and facilitate water drainage, in the embodiment shown in FIGS. 12 and 13, the center line of the longitudinal section of the through-hole 210 is an arc line. In this embodiment, the included angle between the positions of the through-holes 210 is 90°, and four through-holes 210 are arranged in the energy-absorbing and yielding terminal 200 at an even angular interval. Similarly, as shown in FIGS. 5 and 6, the structure and arrangement of the drainage holes arranged in the stressed expansion-cracking terminal 300 are essentially the same as those of the through-holes 210 arranged in the energy-absorbing and yielding terminal 200. Four drainage holes are arranged at 90° angular interval on the circumference of the stressed expansion-cracking terminal 300, and the center line of the longitudinal section of each drainage hole is an arc line. It should be noted that the longitudinal section of the drainage hole is not necessarily shaped into an arc line; alternatively, the drainage hole may be a straight drainage hole or in a different shape, without affecting the drainage of accumulated goaf water; in actual applications, the shape of the longitudinal section of the drainage hole may be selected as required; likewise, the size and quantity of the through-holes 210 may be adjusted and set according to the actual requirement.

Embodiment 2

Figure 15:
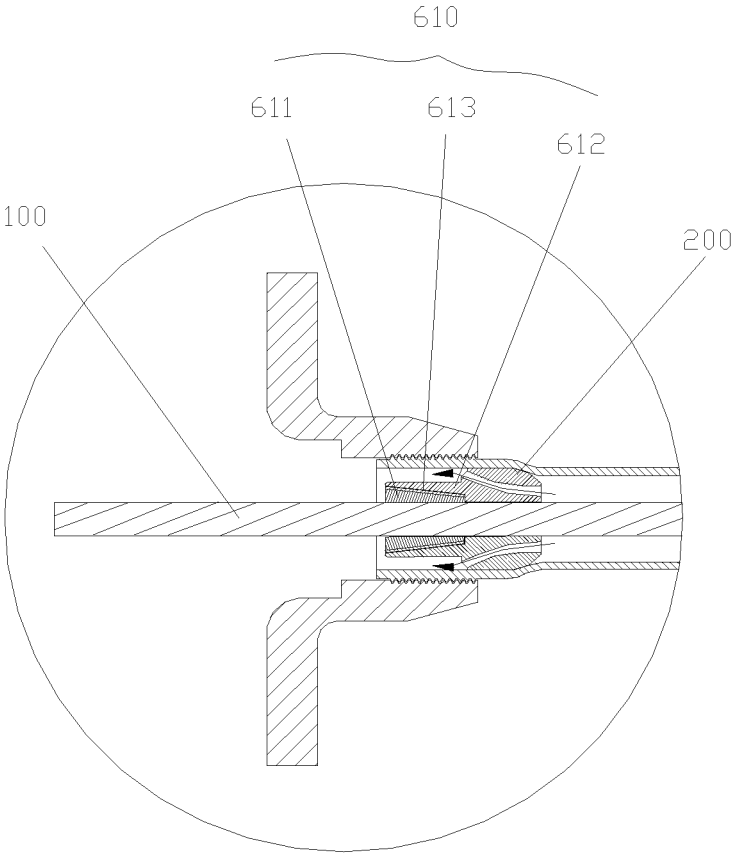
FIG. 15 is a partial schematic structural diagram of the energy-absorbing and yielding terminal and the first lock of the self-anchored opposite-pulling anti-impact anchor cable for sectional coal pillars in embodiment 2 of the present invention.
Figure 16:
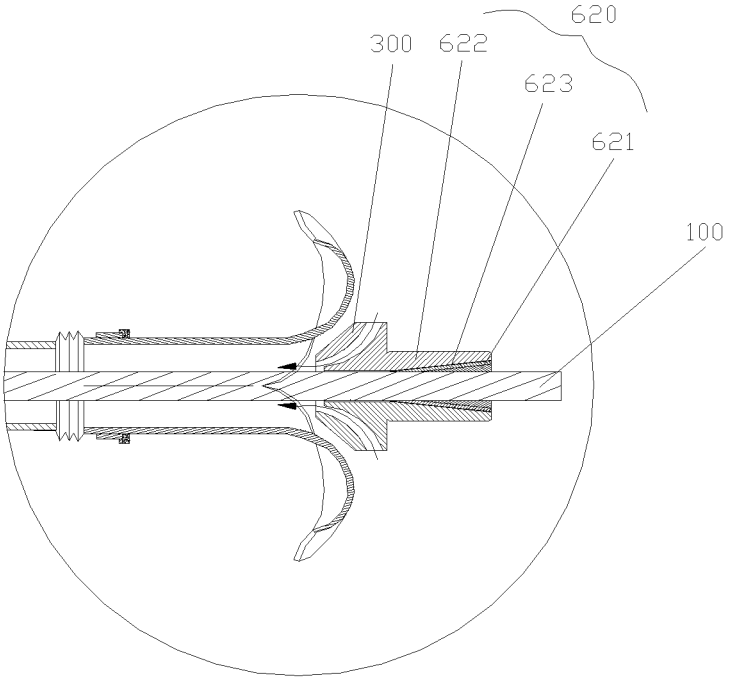
FIG. 16 is a partial schematic structural diagram of the stressed expansion-cracking terminal and the second lock of the self-anchored opposite-pulling anti-imp act anchor cable for sectional coal pillars in embodiment 2 of the present invention.

The embodiment shown in FIGS. 15 and 16 is an improvement based on the structure of the embodiment 1. Compared with the embodiment 1, the difference of this embodiment lies in that the energy-absorbing and yielding terminal 200 and the first lock 610 are not separate components, and the stressed expansion-cracking terminal 300 and the second lock 620 are not separate components. As shown in FIGS. 15 and 16, the first self-locking outer ring 612 and the energy-absorbing and yielding terminal 200 are integral, and the second self-locking outer ring 622 and the stressed expansion-cracking terminal 300 are also integral. As shown in FIG. 15, similar to the above embodiment 1, the first lock 610 comprises a first self-locking inner ring 611 sleeved outside the steel strand 100 and a first self-locking outer ring 612 movably compressed on the first self-locking inner ring 611, and the first self-locking inner ring 611 and the first self-locking outer ring 612 are compressed to each other by means of first bevel surfaces 613 that are arranged correspondingly. As shown in FIG. 16, the second lock 620 also comprises a second self-locking inner ring 621 sleeved outside the steel strand 100 and a second self-locking outer ring 622 movably compressed on the second self-locking inner ring 621, and the second self-locking inner ring 621 and the second self-locking outer ring 622 are compressed to each other by means of second bevel surfaces 623 that are arranged correspondingly. Similarly, the first lock 610 and the second lock 620 in this embodiment attain a limiting effect for the steel strand 100, so as to avoid axial displacement of the steel strand 100 after the steel strand 100 is mounted on the sectional coal pillar. Apparently, in this embodiment, since the first self-locking outer ring 612 and the energy-absorbing and yielding terminal 200 are integral and the second self-locking outer ring 622 and the stressed expansion-cracking terminal 300 are also integral, the structure is simpler and more compact, and is more convenient to install and remove while ensuring a self-locking effect, when compared with the embodiment 1. In view that the other structures in this embodiment are the same as those in the embodiment 1, please refer to the embodiment 1 for the details of those structures.

Figure 17:
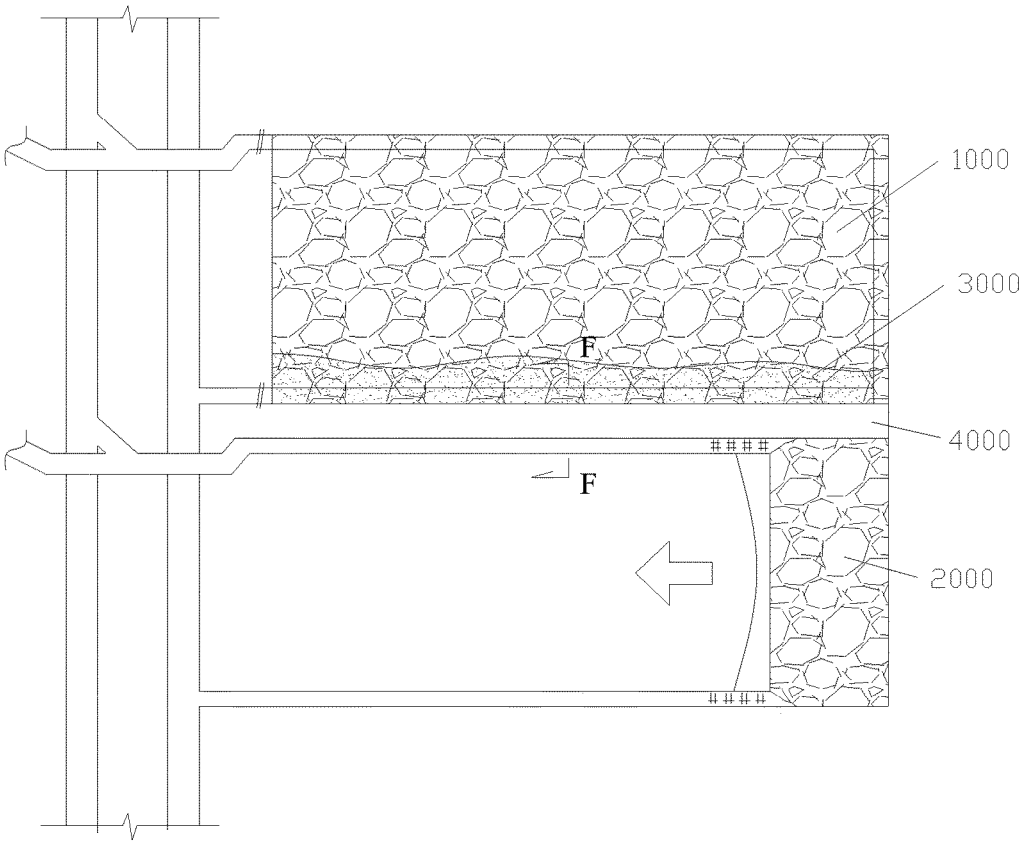
FIG. 17 is a schematic structural diagram of a sectional coal pillar between the mining faces of two adjacent sections in the present invention.
Figure 18:
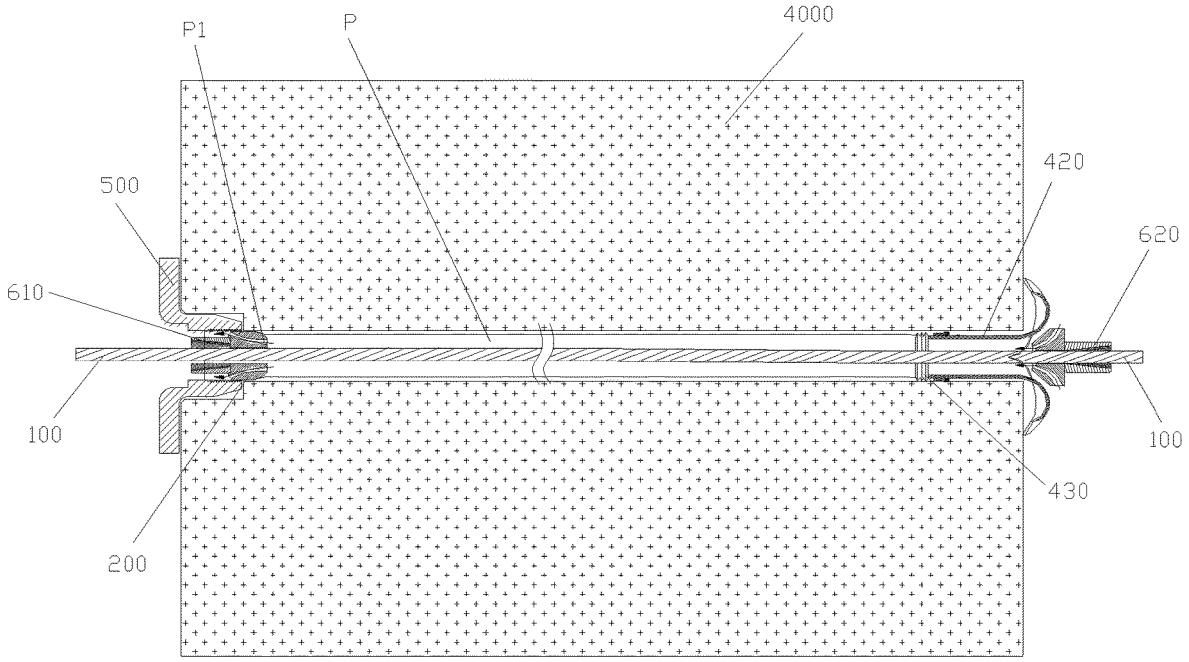
FIG. 18 is a broken-out sectional view F-F of the structure in FIG. 17, illustrating the mounting structure of the self-anchored opposite-pulling anti-impact anchor cable for sectional coal pillars on a sectional coal pillar in the present invention.
Figure 19:
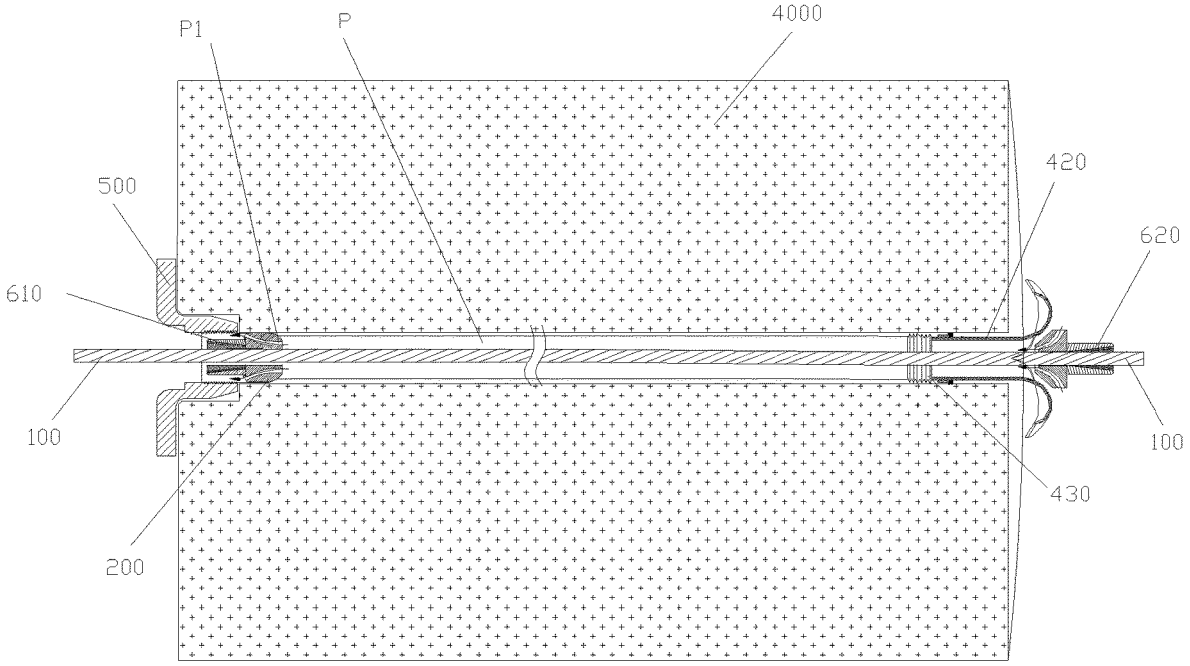
FIG. 19 is a schematic structural diagram of the self-anchored opposite-pulling anti-impact anchor cable for sectional coal pillars shown in FIG. 18 after twice energy absorption.

The using method of the self-anchored opposite-pulling anti-impact anchor cable for sectional coal pillars provided in the embodiment 1 and embodiment 2 will be detailed below with reference to FIGS. 17-20. As shown in FIG. 17, the coal mining area includes a goaf of mining face in upper section 1000 and a goaf of mining face in lower section 2000, which are adjacent to each other; there is a sectional coal pillar 4000 between the goaf of mining face in upper section 1000 and the goaf of mining face in lower section 2000, and goaf water in upper section 3000 exists in the goaf of mining face in upper section 1000. FIGS. 18 and 19 are sectional views F-F of the structure in FIG. 17 respectively, illustrating the positional relationship of the structures after the self-anchored opposite-pulling anti-impact anchor cable for sectional coal pillars provided in the above embodiment 1 of the present invention is mounted and fixed in the sectional coal pillar 4000. The goaf water in upper section 3000 can be drained off effectively with the self-anchored opposite-pulling anti-impact anchor cable for sectional coal pillars provided by the present invention. The mounting and fixing process of the self-anchored opposite-pulling anti-impact anchor cable for sectional coal pillars in the sectional coal pillar 4000 generally comprises the following steps:

step 100: drilling a hole from one side of the sectional coal pillar toward the other side of the sectional coal pillar, with 100 mm-200 mm spacing reserved between the bottom of the drilled hole and the penetration surface on the other side of the sectional coal pillar;

step 200: plugging the drainage hole in the energy-absorbing and yielding terminal of the self-anchored opposite-pulling anti-impact anchor cable for sectional coal pillars in advance, and inserting the self-anchored opposite-pulling anti-impact anchor cable for sectional coal pillars to the bottom of the drilled hole, so that the self-anchored opposite-pulling anti-impact anchor cable for sectional coal pillars presses the drilled hole and penetrates through the spacing reserved in the step 100;

step 300: pressing the bushing and pulling the steel strand outwards, till the end of the bushing is split, seals the drilled hole and is fixed inside the drilled hole, thus the self-anchored opposite-pulling anti-impact anchor cable for sectional coal pillars is mounted on the sectional coal pillar;

step 400: opening the drainage hole and draining the accumulated water timely.

To adapt to the particularities of different mine environments in actual applications, the method further comprises the following step before the step 100: calculating and selecting the matching parameters of the self-anchored opposite-pulling anti-impact anchor cable for sectional coal pillars according to the working conditions.

Specifically, the step 100 comprises: selecting a drill bit in size matching the size of the bushing and drilling a hole with the drill bit to the other side of the sectional coal pillar during the roadway driving along the mining face in the lower section.

More specifically, the step 400 comprises: monitoring the fluid pressure in the bushing, and opening the drainage hole to drain water when the fluid pressure exceeds a pressure threshold; wherein the pressure threshold is 0.2 MPa-0.5 MPa.

The actual operations of the installation and fixing process of the self-anchored opposite-pulling anti-impact anchor cable for sectional coal pillars in the sectional coal pillar 4000 are as follows: firstly, the parameters of the self-anchored opposite-pulling anti-impact anchor cable for sectional coal pillars are selected; specifically, the total length of the self-anchored opposite-pulling anti-impact anchor cable for sectional coal pillars, the dimensions of the self-anchored bushing 420, the quantity of the pre-splitting lines 440, and the parameter of matching between the stressed expansion-cracking terminal 300 and the self-anchored bushing 420, the dimensions of the water drainage bushing 410, and the parameter of matching between the energy-absorbing and yielding terminal 200 and the water drainage bushing 410, etc., are selected reasonably through calculation, according to the specific working conditions, and the strength of the threaded connection of the anchor cable tray 500 is selected reasonably. Specifically, the above-mentioned specific working conditions may include: ground stress, coal rock strength, reserved coal pillar width, and physical and mechanical properties of roof and floor, etc. The installation stage may be commenced after the process parameters of the self-anchored opposite-pulling anti-impact anchor cable for sectional coal pillars to be used are selected and determined. A hole having radius Rdrill is drilled in the sectional coal pillar 4000, specifically, a drill bit in size matching the enlarged section 411 of the water drainage bushing 410 is selected and a hole is drilled with the drill bit during roadway driving along the mining face in the lower section; the hole is drilled from one side of the sectional coal pillar toward the other side of the sectional coal pillar, with 100 mm-200 mm spacing reserved between the bottom of the hole and the penetration surface on the other side of the sectional coal pillar, to prevent the sectional coal pillar 4000 from drilled through fully, which may result in direct drainage of the accumulated goaf water. The overall dimensions of the sectional coal pillar 4000 may be measured in advance before the drilling. Usually the radius of the drilled hole in the coal pillar may be 40 mm-150 mm, e.g., 42 mm in common situations, according to the specific stratigraphic configuration. To prevent the drainage of the accumulated goaf water in the mounting process, the drainage hole P1 arranged in the energy-absorbing and yielding terminal 200 of the self-anchored opposite-pulling anti-impact anchor cable for sectional coal pillars shall be plugged in advance. Secondly, when the self-anchored opposite-pulling anti-impact anchor cable for sectional coal pillars is inserted to the bottom of the drilled hole, the water drainage bushing 410 must be pressed by means of an implement, so that the water drainage bushing 410 presses the drilled hole and penetrates through the reserved 100 mm-200 mm length; in addition, the steel strand 100 is pulled outwards, so that the self-anchored bushing 420 initiates "squeeze-expand-split" actions, till the self-anchored bushing 420 is split to the crack-arresting ring 450; the resin anchoring agent accommodated in the bonding portion 460 is released as the bonding portion 460 is compressed by the wall of the self-anchored bushing 420, and completely seal the space between the self-anchored bushing 420 and the drilled hole. Thus, the self-anchored bushing 420 is self-anchored and fixed on the other side of the sectional coal pillar 4000 after it is split. Then, the anchor cable tray 500 is connected to the enlarged section 411 of the water drainage bushing 410 through the threaded connection, the water drainage bushing 410 is fixed, the steel strand 100 is tensioned, and the first lock 610 is pushed, and then pre-tightening force is applied under the constraint of the second lock 620; thus, the anchor cable is installed. Finally, after the self-anchored opposite-pulling anti-impact anchor cable for sectional coal pillars is mounted and fixed stably in the sectional coal pillar 4000, the drainage hole P1 in the energy-absorbing and yielding terminal 200 may be opened for drainage of the accumulated goaf water at required time for a required duration. Specifically, in the case of the drainage of the accumulated goaf water, the fluid pressure in the bushing must be monitored, and the drainage hole must be opened for drainage once the fluid pressure exceeds a pressure threshold; usually, the pressure threshold is 0.2 MPa-0.5 MPa.

As shown in FIGS. 18 and 19, it should be noted: once deformation of the sectional coal pillar 4000 occurs after the self-anchored opposite-pulling anti-impact anchor cable for sectional coal pillars is mounted in the sectional coal pillar 4000, energy absorption for the primary deformation of the bushing 400 in the axial direction may be achieved by means of elongation of the telescopic energy-absorbing tube 430 in the mounting process of the sectional coal pillar in the self-anchored opposite-pulling anti-impact anchor cable for sectional coal pillars; secondly, the energy-absorbing and yielding terminal 200 moves axially along the water drainage bushing 410 and forces the transition section 413 to displace; thus, the enlarged section 411 is deformed and elongated for secondary energy absorption.

Figure 1:
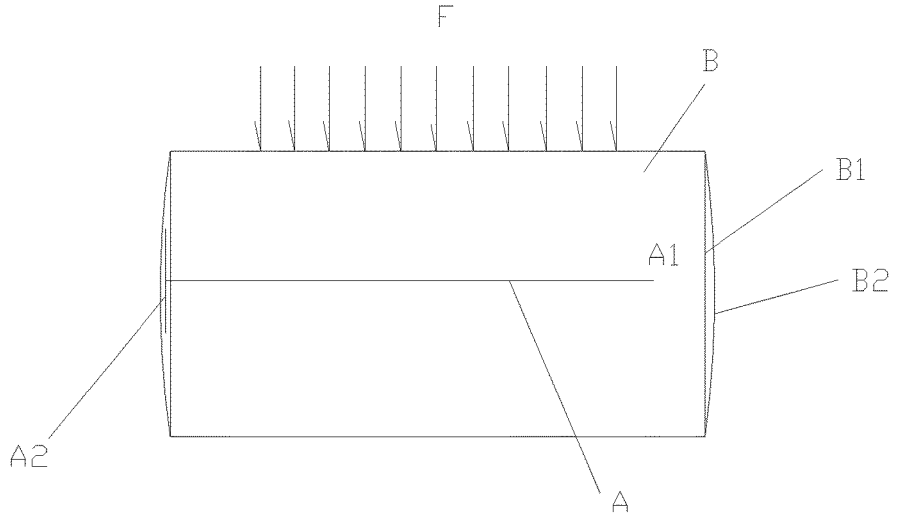
FIG. 1 is a schematic diagram of the fixing structure of an existing anchor cable in a coal pillar.
Figure 20:
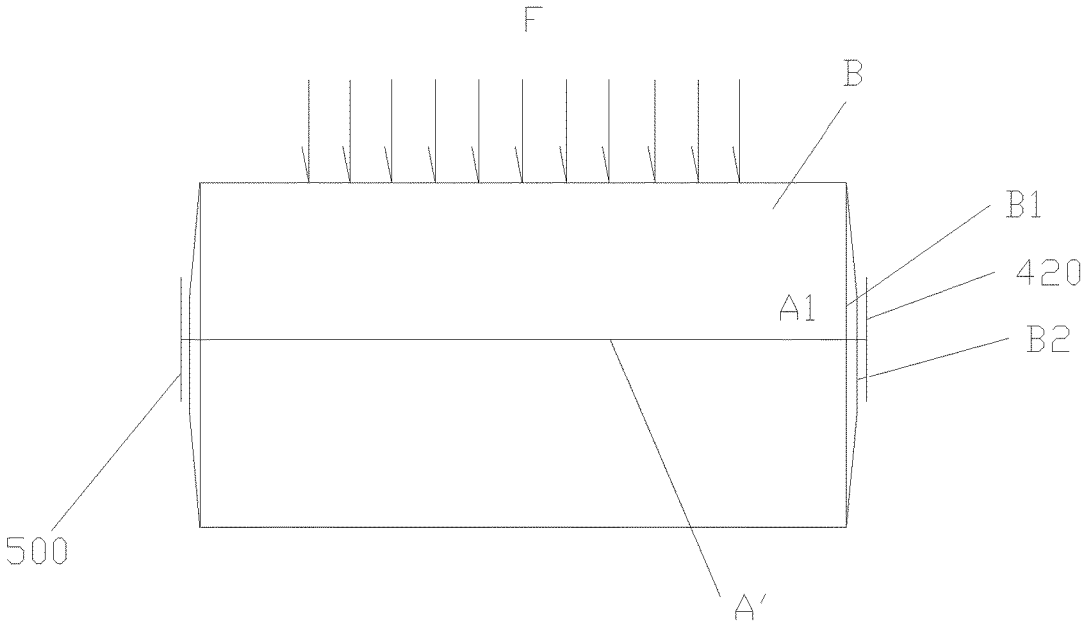
FIG. 20 is a schematic diagram of the fixing structure of the self-anchored opposite-pulling anti-impact anchor cable for sectional coal pillars in the coal pillar in the present invention.

As shown in FIG. 20 in comparison with FIG. 1, with the self-anchored opposite-pulling anti-impact anchor cable for sectional coal pillars provided by the present invention, the two ends of the anchor cable A' crack, bend, and expand along the pre-splitting lines 440 by means of the anchor cable tray 500 and the wall of the end portion of the self-anchored bushing 420, and abut against and is self-anchored to the two sides of the edge of the coal pillar B. When the coal pillar B is subjected to force F, compressional deformation of the coal pillar B occurs in the stressed direction, and the two sides B1 of the coal pillar B will be deformed and tend to form bulged edges B2. The telescopic energy-absorbing tube 430 may be elongated in the mounting process of the self-anchored opposite-pulling anti-impact anchor cable for sectional coal pillars on the sectional coal pillar and thereby absorbs energy in the primary deformation of the bushing 400 in the axial direction; the energy-absorbing and yielding terminal 200 moves in the axial direction of the water drainage bushing 410 and forces the transition section 413 to displace, the enlarged section 411 is deformed and elongated for secondary energy absorption, so that the deformation of the coal pillar B is absorbed fully. In addition, the situation of loose and failed anchor cable as shown in FIG. 1 in the prior art will never occur as long as the anchor cable is not broken. Thus, effective support for the coal pillar is provided.

It is seen from the above description: to overcome the existing drawbacks in the prior art, the present invention provides a self-anchored opposite-pulling anti-imp act anchor cable for sectional coal pillars and a using method thereof. Firstly, the self-anchored opposite-pulling anti-impact anchor cable for sectional coal pillars provided by the present invention can realize mechanical self-anchorage, successfully avoids excessive dependence of the anchoring with the "anchor cable-coal rock" anchoring agent on the integrality and stability of the coal mass, attains a "opposite-pulling and energy-absorptive anchoring" effect on the two sides of the coal pillar, and prevents failure of the anchored end incurred by deformation and damage of the yielding coal pillar; secondly, the self-anchored opposite-pulling anti-impact anchor cable for sectional coal pillars attains energy absorption, yielding, stable supporting effects, achieves coordinated dynamic deformation with the coal pillar, adapts to the large deformation characteristic of the coal pillar, and prevents coal pillar instability and impact incurred by overload and tensile failure; in addition, utilizing the space arranged between the bushing and the steel strand, the drainage of the accumulated goaf water at the goaf side of the coal pillar is realized effectively, and the coal mass is protected against persistent soaking and softening by the accumulated water, which may cause compromised bearing stability of the coal pillar. In summary, the self-anchored opposite-pulling anti-impact anchor cable for sectional coal pillars provided by the present invention can simultaneously realize three functions of safe drainage of accumulated water at the goaf side of the coal pillar, coordination of energy absorption and impact resistance with large deformation, and mechanical self-anchorage of the anchor cable. According to the strength and deformation condition of the coal and rock mass of the sectional coal pillar, the self-anchored opposite-pulling anti-impact anchor cable for sectional coal pillars can be used in conjunction with coal mass cementing process and protection of coal pillars in the roadway with steel beams, and the like, and has a simple and compact structure and high safety and controllability.

While the present invention is described above in detail in some preferred embodiments with reference to the accompanying drawings, the present invention is not limited to those embodiments. Various simple variations may be made to the technical scheme of the present invention within the technical concept of the present invention. For example, the stressed expansion-cracking terminal arranged at the end of the steel strand may be removed, and a resin anchoring agent may be applied on the end of the steel strand, so that the end of the steel strand is directly bonded, mounted and positioned inside the drilled hole. To avoid unnecessary repetition, the possible combinations are not described specifically in the present invention. However, such simple variations and combinations shall also be deemed as having been disclosed and falling in the scope of protection of the present invention.

The invention claimed is:

1. A self-anchored opposite-pulling anti-impact anchor cable for sectional coal pillars, comprising a steel strand (100), with an energy-absorbing and yielding terminal (200) and a stressed expansion-cracking terminal (300) respectively fixed to two ends of the steel strand (100) and a bushing (400) sleeved outside the steel strand (100), wherein a first lock (610) is provided at one end of the steel strand (100) for locking the energy-absorbing and yielding terminal (200) to the steel strand (100), and a second lock (620) is provided at the other end of the steel strand (100) for locking the stressed expansion-cracking terminal (300) to the steel strand (100); the stressed expansion-cracking terminal (300) comprises a self-anchored bushing (420) with a plurality of pre-splitting lines (440) arranged in the wall of the self-anchored bushing (420), and the wall of the self-anchored bushing (420) cracks along the pre-splitting lines (440) and bends and expands under stress, so that it abuts against and is self-anchored to the edge of a sectional coal pillar at the outer side.

2. The self-anchored opposite-pulling anti-impact anchor cable for sectional coal pillars of claim 1, wherein the first lock (610) comprises a first self-locking inner ring (611) sleeved outside the steel strand (100) and a first self-locking outer ring (612) movably compressed on the first self-locking inner ring (611), and the first self-locking inner ring (611) and the first self-locking outer ring (612) are self-locked and compressed to each other by means of first bevel surfaces (613) that are arranged correspondingly; the second lock (620) comprises a second self-locking inner ring (621) sleeved outside the steel strand (100) and a second self-locking outer ring (622) movably compressed on the second self-locking inner ring (621), and the second self-locking inner ring (621) and the second self-locking outer ring (622) are self-locked and compressed to each other by means of second bevel surfaces (623) that are arranged correspondingly.

3. The self-anchored opposite-pulling anti-impact anchor cable for sectional coal pillars of claim 2, wherein the first self-locking outer ring (612) and the energy-absorbing and yielding terminal (200) are arranged integrally; and the second self-locking outer ring (622) and the stressed expansion-cracking terminal (300) are arranged integrally.

4. The self-anchored opposite-pulling anti-impact anchor cable for sectional coal pillars of claim 1, wherein the bushing (400) comprises a water drainage bushing (410) sleeved outside the energy-absorbing and yielding terminal (200) and a self-anchored bushing (420) sleeved outside the stressed expansion-cracking terminal (300), and the water drainage bushing (410) and the self-anchored bushing (420) are connected via a telescopic energy-absorbing tube (430).

5. The self-anchored opposite-pulling anti-impact anchor cable for sectional coal pillars of claim 4, wherein an anchor cable tray (500) is provided outside the end of the water drainage bushing (410), and an end of the water drainage bushing (410) is connected with the anchor cable tray (500) by means of threads that are arranged correspondingly.

6. The self-anchored opposite-pulling anti-impact anchor cable for sectional coal pillars of claim 5, wherein the water drainage bushing (410) comprises an enlarged section (411) and a straight section (412) having an inner diameter smaller than the inner diameter of the enlarged section (411), and the enlarged section (411) is connected with the straight section (412) through a transition section (413);

the energy-absorbing and yielding terminal (200) is arranged inside the enlarged section (411), and comprises a first cylindrical section (230) and a circular-arc truncated cone section (240), and the periphery of the end face of the circular-arc truncated cone section (240) is positioned in fit to the transition section (413) after the self-anchored opposite-pulling anti-impact anchor cable for sectional coal pillars is mounted on the sectional coal pillar (4000);

when the sectional coal pillar (4000) is deformed under stress after the self-anchored opposite-pulling anti-impact anchor cable for sectional coal pillars is mounted on the sectional coal pillar (4000), the energy-absorbing and yielding terminal (200) moves axially along the water drainage bushing (410) and thereby force the transition section (413) to deform and displace, so that the enlarged section (411) is elongated and absorbs energy.

7. The self-anchored opposite-pulling anti-impact anchor cable for sectional coal pillars of claim 6, wherein the stressed expansion-cracking terminal (300) comprises a second cylindrical section (310) and a circular truncated cone section (320), and an truncated cone end face of the circular truncated cone section (320) is oriented to the self-anchored bushing (420), after the self-anchored opposite-pulling anti-impact anchor cable for sectional coal pillars is mounted on the sectional coal pillar (4000), the truncated cone end face extrudes the wall of the self-anchored bushing (420), so that the wall of the self-anchored bushing (420) cracks, bends and expands along the pre-splitting lines (440).

8. The self-anchored opposite-pulling anti-impact anchor cable for sectional coal pillars of claim 4, wherein the plurality of pre-splitting lines (440) are arranged in parallel to each other at a constant angle in the circumferential direction in the wall of the self-anchored bushing (420).

9. The self-anchored opposite-pulling anti-impact anchor cable for sectional coal pillars of claim 8, wherein a crack-arresting ring (450) is arranged on the outer wall of the self-anchored bushing (420) at a position in front of the telescopic energy-absorbing tube (430) in a direction in which the self-anchored opposite-pulling anti-impact anchor cable for sectional coal pillars is inserted into the sectional coal pillar (4000).

10. The self-anchored opposite-pulling anti-impact anchor cable for sectional coal pillars of claim 9, wherein the outer wall of the self-anchored bushing (420) has a bonding portion (460) that accommodates a resin anchoring agent that can be released under extrusion, and the bonding portion (460) is arranged near the crack-arresting ring (450).

11. The self-anchored opposite-pulling anti-impact anchor cable for sectional coal pillars of claim 1, wherein an annular space (S) is reserved between the inner wall of the bushing (400) and the outer surface of the steel strand (100), and, after the self-anchored opposite-pulling anti-impact anchor cable for sectional coal pillars is mounted on the sectional coal pillar (4000), two ends of the annular space (S) work with a side of the energy-absorbing and yielding terminal (200) that faces the annular space (S) and a side of the stressed expansion-cracking terminal (300) that faces the annular space (S) respectively to enclose and form an enclosed drainage path (P), the energy-absorbing and yielding terminal (200) and the stressed expansion-cracking terminal (300) are respectively provided with a drainage hole (P1) there-through, and the drainage path (P) is in communication with the drainage holes (P1).

12. The self-anchored opposite-pulling anti-impact anchor cable for sectional coal pillars of claim 11, wherein the cross section of the annular space (S) accounts for 30-50% of the overall cross section of the inner cavity of the bushing (400).

13. The self-anchored opposite-pulling anti-impact anchor cable for sectional coal pillars of claim 11, wherein the drainage holes (P1) are a plurality of through-holes (210) that are circumferentially arranged at a constant angle in the axial direction of the energy-absorbing and yielding terminal (200) and the stressed expansion-cracking terminal (300).

14. The self-anchored opposite-pulling anti-impact anchor cable for sectional coal pillars of claim 13, wherein the center line of the longitudinal section of the through-hole (210) is an arc line.

15. A method of using the self-anchored opposite-pulling anti-impact anchor cable for sectional coal pillars of claim 1, comprising the following steps:

step 100: drilling a hole from one side of the sectional coal pillar toward the other side of the sectional coal pillar, with 100 mm-200 mm spacing reserved between the bottom of the drilled hole and the penetration surface on the other side of the sectional coal pillar;

step 200: plugging the drainage hole in the energy-absorbing and yielding terminal of the self-anchored opposite-pulling anti-impact anchor cable for sectional coal pillars in advance, and inserting the self-anchored opposite-pulling anti-impact anchor cable for sectional coal pillars to the bottom of the drilled hole, so that the self-anchored opposite-pulling anti-impact anchor cable for sectional coal pillars presses the drilled hole and penetrates through the spacing reserved in the step 100;

step 300: pressing the bushing and pulling the steel strand outwards, till the end of the bushing is split and then seals the drilled hole and is fixed inside the drilled hole, thus the self-anchored opposite-pulling anti-impact anchor cable for sectional coal pillars is mounted on the sectional coal pillar;

step 400: opening the drainage hole and draining the accumulated water timely.

16. The method of using the self-anchored opposite-pulling anti-impact anchor cable for sectional coal pillars of claim 15, further comprising the following step before the step 100: calculating and selecting the matching parameters of the self-anchored opposite-pulling anti-impact anchor cable for sectional coal pillars according to the working conditions.

17. The method of using the self-anchored opposite-pulling anti-impact anchor cable for sectional coal pillars of claim 15, wherein the step 100 specifically comprises: selecting a drill bit in size matching the size of the bushing and drilling a hole with the drill bit to the other side of the sectional coal pillar during the roadway driving along the mining face in the lower section.

18. The method of using the self-anchored opposite-pulling anti-impact anchor cable for sectional coal pillars of claim 15, wherein the step 400 comprises: monitoring the fluid pressure in the bushing, and opening the drainage hole to drain water when the fluid pressure exceeds a pressure threshold; wherein the pressure threshold is 0.2 MPa-0.5 MPa.

* * * * *